US010869516B2

(12) United States Patent
Sokoloff

(10) Patent No.: US 10,869,516 B2
(45) Date of Patent: Dec. 22, 2020

(54) SPECIALIZED SWIM CAP FOR WEARERS WITH SPECIAL NEEDS

(71) Applicant: Brandeis University, Waltham, MA (US)

(72) Inventor: Rebecka Lauren Sokoloff, Northborough, MA (US)

(73) Assignee: Brandeis University, Waltham, MA (US)

( * ) Notice: Subject to any disclaimer, the term of this patent is extended or adjusted under 35 U.S.C. 154(b) by 28 days.

(21) Appl. No.: 15/787,284

(22) Filed: Oct. 18, 2017

(65) Prior Publication Data

US 2019/0014845 A1 Jan. 17, 2019

Related U.S. Application Data

(60) Provisional application No. 62/531,489, filed on Jul. 12, 2017.

(51) Int. Cl.
*A42B 1/12* (2006.01)
*A42B 1/24* (2006.01)

(52) U.S. Cl.
CPC ..... *A42B 1/12* (2013.01); *A42B 1/247* (2013.01)

(58) Field of Classification Search
CPC ..... A42B 1/12; A42B 1/247; A42B 1/004; A42B 1/041; A42B 1/043; A42B 7/00; A63B 33/00; A41D 2400/44; A41D 27/22
USPC ..... 2/68; 128/866; 24/578.13
See application file for complete search history.

(56) References Cited

U.S. PATENT DOCUMENTS 494,825 A * 4/1893 Spicer ..... C04B 35/5607 24/575.1
1,654,479 A * 12/1927 Fenton ..... A44B 17/0005 24/688
2,132,864 A * 10/1938 Suthers ..... A42B 1/12 128/866
2,286,652 A * 6/1942 Sheffield ..... A42B 1/12 2/68

(Continued)

FOREIGN PATENT DOCUMENTS

EP 1900396 A2 * 3/2008 ..... A42B 1/12
GB 221506 A * 12/1924 ..... A42B 1/12

(Continued)

OTHER PUBLICATIONS

"Wire", Merriam-Webster, https://www.merriam-webster.com/dictionary/wire, last visited Apr. 23, 2020.*

*Primary Examiner* — Alissa L Hoey
*Assistant Examiner* — Patrick J. Lynch
(74) *Attorney, Agent, or Firm* — Troutman Pepper Hamilton Sanders LLP (Rochester)

(57) ABSTRACT

Individuals with special needs often struggle to put on swim caps as they may lack dexterity, strength, or coordination to pull the cap over their ears. An improved swim cap to aid such wearers includes a swim cap body to encapsulate an upper head area and ears of a wearer, a first ring near a right ear area of the cap, and a second ring near a left ear area the body. A reinforcing band is attached on an interior of the swim cap body, wherein ends of the band connect to the first ring and the second ring. The rings allow for easy gripping of the swim cap to easily pull the cap over the wearer's head and ears.

11 Claims, 2 Drawing Sheets

(56) References Cited

U.S. PATENT DOCUMENTS 3,005,203 A * 10/1961 Aileo ..... A42B 3/166 2/423
3,274,612 A * 9/1966 Merriam ..... A42B 3/00 2/421
3,296,582 A * 1/1967 Ide ..... G10K 11/002 181/125
3,686,689 A * 8/1972 Berlinski ..... A42B 1/12 2/68
4,011,598 A * 3/1977 Sherr ..... A42B 1/12 2/68
5,978,967 A * 11/1999 Williams ..... A42B 1/046 2/172
6,389,607 B1 * 5/2002 Wood ..... A42B 3/00 2/411
7,698,836 B2 * 4/2010 Schmelzer ..... A43B 3/0078 36/136
8,474,064 B2 * 7/2013 Hardy, III ..... G09F 21/02 2/10
2003/0159707 A1 * 8/2003 Di Luca ..... A42B 1/041 132/270
2008/0045871 A1 * 2/2008 Allen ..... A61F 5/05891 602/17
2008/0060110 A1 * 3/2008 Schmelzer ..... A44B 1/32 2/69
2009/0055995 A1 * 3/2009 Garza ..... A42B 1/006 2/209.11
2009/0144885 A1 * 6/2009 Mix ..... A63B 33/00 2/421
2014/0230836 A1 * 8/2014 Green ..... A46B 9/023 132/120
2015/0209621 A1 * 7/2015 Cason ..... A63B 33/00 2/68
2015/0289048 A1 * 10/2015 Schermerhorn ..... H04R 1/1091 381/376
2016/0331056 A1 * 11/2016 Son ..... A42B 1/006
2019/0070431 A1 * 3/2019 Zivin ..... H05K 1/0203

FOREIGN PATENT DOCUMENTS

GB 388330 A * 2/1933 ..... A42B 1/12
WO WO-03059103 A1 * 7/2003 ..... A63B 71/10

* cited by examiner

SPECIALIZED SWIM CAP FOR WEARERS WITH SPECIAL NEEDS

CROSS-REFERENCE TO RELATED APPLICATION

This application claims the benefit of priority of U.S. provisional application No. 62/531,489, filed Jul. 12, 2017, the contents of which are herein incorporated by reference.

BACKGROUND OF THE INVENTION

This invention relates to swim caps, and more particularly to swim caps for wearers with special needs.

Often, individuals with special needs struggle to put on swim caps as they may lack dexterity, strength, or coordination to pull the cap over their ears. Additionally, the aiders who assist the special needs wearers also struggle in putting the cap on for the wearer. Conventional swim caps are difficult to pull over the scalp and are prone to being dislodged during activity.

There exists a need for a swim cap that is easily put on by individuals with disabilities, those who lack dexterity such as people with musculoskeletal and neuromuscular disorders, and those who are aiding in placing the swim cap on the wearer.

SUMMARY

In one embodiment, a swim cap includes a silicone swim cap body to encapsulate an upper head area and ears of a wearer, a first ring near a right ear area of the swim cap body, a second ring near a left ear area of the swim cap body, and a band attached on an inside of the swim cap body, wherein ends of the band connect to the first ring and the second ring.

In one embodiment, the first ring and second ring are on an inside of the swim cap. In one embodiment, the first ring and second ring are on the outside of the swim cap.

In one embodiment, the first ring and second ring are made of metal. In one embodiment, the swim cap further includes a goggle attachment clip attached to a back of the swim cap to which to secure swim goggle straps.

In one embodiment, the band is attached from the first ring to the second ring through a top area of the cap to reinforce the band around a top of a wearer's head and from one ear to another. In one embodiment, the band is made of a reinforcing material.

In an alternative embodiment, a swim cap includes a silicone swim cap body to encapsulate an upper head area and ears of a wearer, a first hole cut on a right ear area of the swim cap body, a second hole cut on a left ear area of the swim cap body, and a band attached on an inside of the swim cap wherein distal ends of the band connect to the first hole and the second hole.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

As stated above, putting on a swim cap or aiding placement of a swim cap on a person who might lack dexterity, strength, or coordination, is often a struggle. It is difficult for a wearer with limited dexterity to pull the cap completely over their ears. The invention claimed here solves this problem.

Broadly, one embodiment of the present invention is an improved swim cap for those with limited dexterity. A swim cap is made of a smooth silicone and/or latex and looks like a conventional swim cap. The cap, however, includes two reinforced holes that allow the wearer to place their fingers through the openings to give them extra strength to pull down the cap over the ears. In one embodiment, rings can be substituted for the holes.

Figure 1:
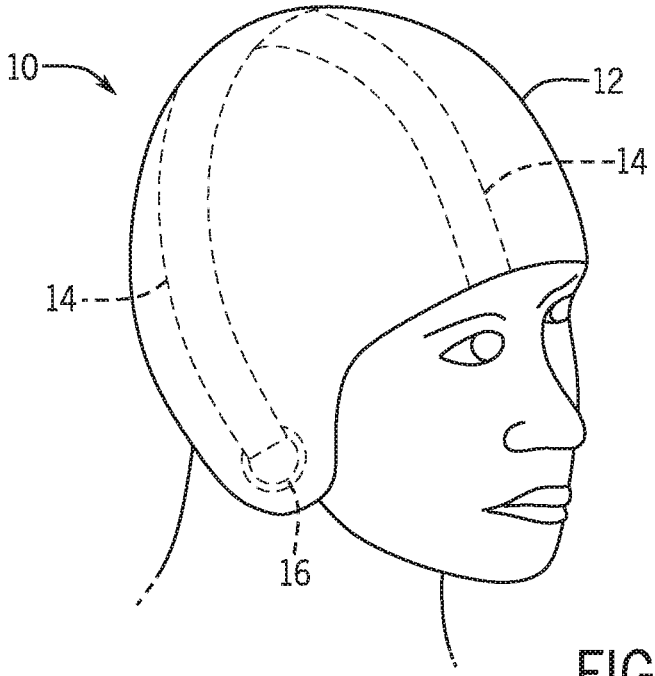
FIG. 1 shows one embodiment a perspective view of the invention in use.

As shown in the embodiment of FIG. 1, inside a cap 12 is a reinforced interior strap or band 14 that connect two interior rings 16 such that the cap does not rip from the extra pulling force on the sides of the cap 12. Each ring 16 is above the left and right ear of the wearer to allow for facilitated gripping and pulling down. In one embodiment, the rings 16 are made of metal or any suitable material. The rings 16 are of a suitable size to attach to the cap 12 and allow for easy gripping. The strap 14 is made of a reinforcing material. In one embodiment, the strap 14 is up to ½ inches wide and up to ⅛-inch thickness. In one embodiment, the strap 14 is made of elastic or silicon, though any suitable material can be used.

Figure 2:
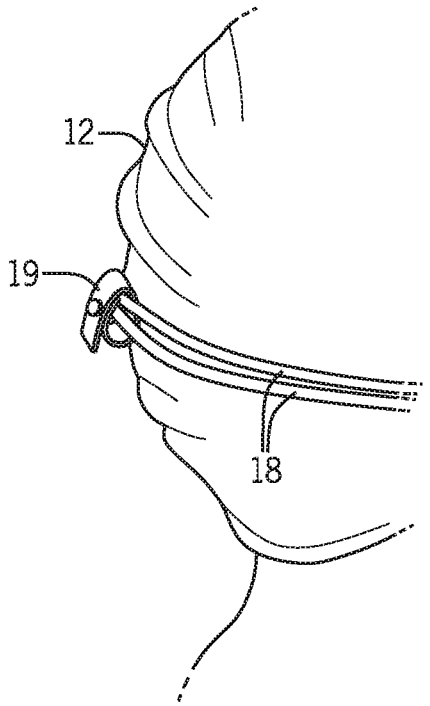
FIG. 2 shows one embodiment of a rear perspective of the invention in detail.

In one embodiment as shown in FIG. 2, the device 10 also includes an optional goggle clip 19 for a pair of swimming goggle straps 18 to secure the goggles. The goggle clip 19 is attached to the back of the cap 12 by any suitable attachment means. In one embodiment for example, the straps of the goggles are held in place by an attached clip.

Figure 3:
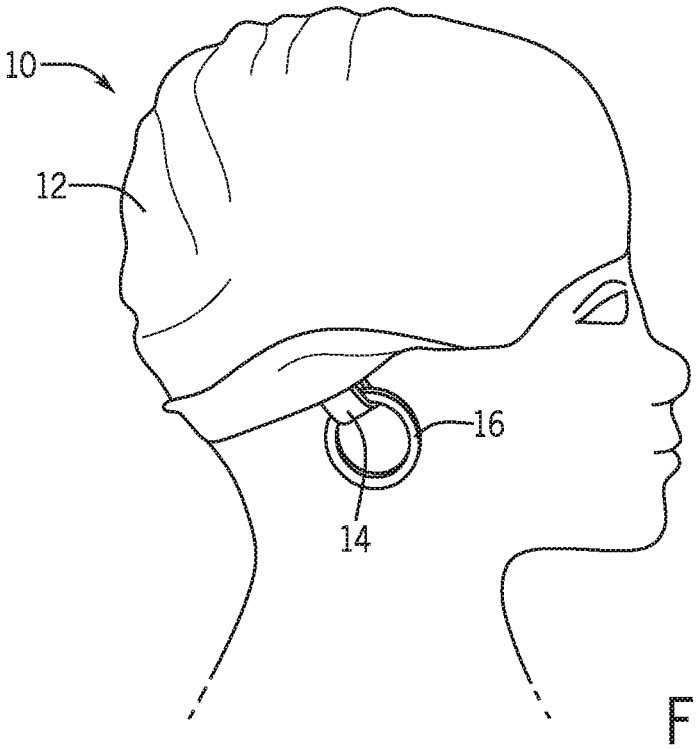
FIG. 3 shows one embodiment of a side elevation view of the invention.

FIG. 3 shows a side view of cap 12 of FIG. 1. The ring 16 is attached to interior strap 14 by being positioned through an end loop of the interior strap 14. It is to be understood, however, that the ring 16 can be attached by any suitable means to the interior strap. The rings 16 have openings which can be gripped and pulled by the wearer to easily pull the cap 12 over the wearer's ears. In an alternative embodiment, the rings 16 may be visible on the outside of the cap 12.

Figure 4:
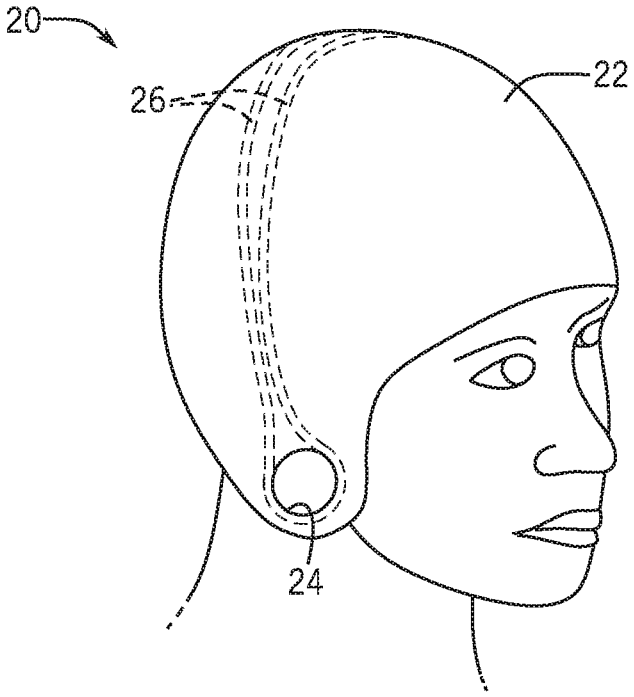
FIG. 4 shows one embodiment of a perspective view of an alternative embodiment of the invention.

An alternative embodiment 20 of a swim cap 22 is shown in FIG. 4. The cap 22 includes a closed loop band 26, strung along and attached to the inside of the cap. The loops of each end of the band 26 are attached to holes 24 around each ear area. The holes fit around each of the wearer's ears. Advantageously, the band 26 with holes 24 allow easy pulling and securing of the cap around the wearer's ears. Alternatively, the banded holes 24 may simply be used to pull the cap 22 down over the ears.

In one embodiment, the holes 24 are reinforced with a reinforcing material around a circumference or portion of a circumference of the holes 24 to allow for easier gripping by a wearer.

Advantageously, the cap can be used by people with special needs, people with neuro-muscular disorders, and novice swimmers to better grips and manipulate swim caps. The cap can also be used in different athletic activities that require a cap, hat, or skull piece.

It should be understood, of course, that the foregoing relates to exemplary embodiments of the invention and that modifications may be made without departing from the spirit and scope of the invention as set forth in the following claims.

What is claimed is:

1. A swim cap comprising: a silicone swim cap body to encapsulate an upper head area and ears of a wearer;

a first circular ring attached to a right ear area of the swim cap body, wherein said first circular ring is configured to permit the wearer to place a finger through the first circular ring;

a second circular ring attached to a left ear area of the swim cap body, wherein said second circular ring is configured to permit the wearer to place a finger through the second circular ring; and a band attached on an interior of the swim cap body, wherein a first distal end of the band forms a first loop and a second distal end of the band forms a second loop and wherein the first circular ring is inserted through the first loop and the second circular ring is inserted through the second loop.

2. The swim cap of claim 1, wherein the first circular ring and the second circular ring are on the interior of the silicone swim cap body.

3. The swim cap of claim 1, wherein the first circular ring and second circular ring are on an exterior of the silicone swim cap body.

4. The swim cap of claim 1, further comprising a goggle attachment clip attached to a back of the swim cap to which to secure swim goggle straps.

5. The swim cap of claim 1, wherein the band is attached from the first circular ring to the second circular ring through a top area of the cap to reinforce the band around a top of a wearer's head and from one ear to another.

6. The swim cap of claim 1, wherein the band is made of a reinforcing material.

7. A swim cap comprising:

a silicone swim cap body to encapsulate an upper head area and ears of a wearer;

a first circular hole cut on a right ear area of the swim cap body, an entire edge on a circumference of the first hole being reinforced with a first single reinforcing material, wherein said first circular hole is configured to permit the wearer to place a finger through the first circular hole;

a second circular hole cut on a left ear area of the swim cap body, an entire edge on a circumference of the second hole being reinforced with a second single reinforcing material, wherein said second circular hole is configured to permit the wearer to place a finger through the second circular hole; and a band attached on an inside of the swim cap body;

wherein the first circular hole and the second circular hole each comprise a left portion, a lower portion, and a right portion and wherein the band extends around the left, lower, and right portions of the first circular hole and the band extends around the left, lower, and right portions of the second circular hole.

8. The swim cap of claim 7, further comprising a goggle attachment clip attached to a back of the swim cap to which to secure swim goggle straps.

9. The swim cap of claim 7, wherein said first circular hole is large enough to fit around the right ear of the wearer and the second circular hole is large enough to fit around the left ear of the wearer.

10. The swim cap of claim 7, wherein the first hole and second hole have a reinforcing material around a circumference of each respective hole.

11. The swim cap of claim 1, wherein the first ring and second ring are made of metal.

* * * * *